US010738978B2

(12) United States Patent
Yang et al.

(10) Patent No.: US 10,738,978 B2
(45) Date of Patent: Aug. 11, 2020

(54) LIGHT SOURCE ASSEMBLY, BACKLIGHT MODULE AND DISPLAY DEVICE

(71) Applicant: BOE TECHNOLOGY GROUP CO., LTD., Beijing (CN)

(72) Inventors: Fan Yang, Beijing (CN); She Lin, Beijing (CN); Xin Wang, Beijing (CN); Xuelin Han, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 124 days.

(21) Appl. No.: 15/556,839

(22) PCT Filed: Feb. 22, 2017

(86) PCT No.: PCT/CN2017/074404

§ 371 (c)(1),
(2) Date: Sep. 8, 2017

(87) PCT Pub. No.: WO2018/000836

PCT Pub. Date: Jan. 4, 2018

(65) Prior Publication Data

US 2019/0120465 A1 Apr. 25, 2019

(30) Foreign Application Priority Data

Jun. 29, 2016 (CN) ..... 2016 2 0673074 U

(51) Int. Cl.
*F21V 19/00* (2006.01)
*F21S 8/00* (2006.01)
(Continued)

(52) U.S. Cl.
CPC ..... *F21V 19/0045* (2013.01); *A47F 11/10* (2013.01); *F21S 8/00* (2013.01);
(Continued)

(58) Field of Classification Search
CPC .... F21V 19/0045; F21V 14/02; F21V 21/005; A47F 11/10; F21W 2131/405; F21S 4/28; F21S 4/20
See application file for complete search history.

(56) References Cited

U.S. PATENT DOCUMENTS 6,582,103 B1 * 6/2003 Popovich ..... F21V 5/02 361/224
7,573,055 B2 * 8/2009 Palatzky ..... F21V 19/0045 250/559.36

(Continued)

FOREIGN PATENT DOCUMENTS

CN 204420783 U 6/2015
CN 205351010 U 6/2016
CN 205748376 U 11/2016

OTHER PUBLICATIONS

Search Report and Written Opinion dated May 26, 2017 from State Intellectual Property Office of the P.R. China.

*Primary Examiner* — Bryon T Gyllstrom
*Assistant Examiner* — Colin J Cattanach
(74) *Attorney, Agent, or Firm* — Dilworth & Barrese, LLP.; Michael J. Musella, Esq.

(57) ABSTRACT

Disclosure are a light source assembly, a backlight module and a display device. The light source assembly includes a light source including a base and at least one luminous element disposed on the base; and a light slot including a plurality of fixing parts, the light source is disposed in the light slot and fixed at one of the fixing parts through the base; and the light source has different light-emitting directions upon being fixed at different ones of the plurality of fixing parts. The light source assembly can adjust the light-emitting direction of the light source, has a simple structure, and is convenient to operate.

13 Claims, 7 Drawing Sheets

(51) Int. Cl.

| | |
|---|---|
| ***A47F 11/10*** | (2006.01) |
| ***F21V 14/02*** | (2006.01) |
| ***G09F 13/00*** | (2006.01) |
| ***F21S 4/20*** | (2016.01) |
| ***F21S 4/28*** | (2016.01) |
| ***F21Y 103/10*** | (2016.01) |
| ***F21Y 115/10*** | (2016.01) |
| ***F21W 131/405*** | (2006.01) |
| ***G09F 5/00*** | (2006.01) |

(52) U.S. Cl.
CPC ..... *F21V 14/02* (2013.01); *F21V 19/00* (2013.01); *G09F 13/00* (2013.01); *F21S 4/20* (2016.01); *F21S 4/28* (2016.01); *F21W 2131/405* (2013.01); *F21Y 2103/10* (2016.08); *F21Y 2115/10* (2016.08); *G09F 5/00* (2013.01)

(56) References Cited

U.S. PATENT DOCUMENTS

| | | | | |
|---|---|---|---|---|
| 9,410,682 | B1 * | 8/2016 | Wang | A47F 5/0068 |
| 2008/0285264 | A1 * | 11/2008 | Whitehouse | A47B 97/00 362/217.05 |
| 2008/0298058 | A1 * | 12/2008 | Kan | F21V 15/01 362/240 |
| 2009/0296381 | A1 * | 12/2009 | Dubord | F21S 2/005 362/218 |
| 2011/0176308 | A1 * | 7/2011 | Wu | F21S 4/28 362/247 |
| 2011/0317435 | A1 * | 12/2011 | Wang | F21V 21/025 362/370 |
| 2013/0271977 | A1 * | 10/2013 | Ronen | F21V 15/013 362/235 |
| 2014/0254169 | A1 * | 9/2014 | Inoue | F21S 8/026 362/296.01 |

* cited by examiner

LIGHT SOURCE ASSEMBLY, BACKLIGHT MODULE AND DISPLAY DEVICE

TECHNICAL FIELD

Embodiments of the present disclosure relate to a light source assembly, a backlight module and a display device.

BACKGROUND

With the rapid development of social informatization, transparent splicing display devices are widely used in a variety of display fields, e.g., advertising show cupboards or physical goods display boxes, due to immersive visual experience provided for observers and good display effects. The transparent splicing device generally requires a backlight module to provide a light source, so as to provide better display.

SUMMARY

At least one embodiment of the present disclosure provides a light source assembly. The light source assembly includes a light source including a base and at least one luminous element disposed on the base; and a light slot including a plurality of fixing parts, the light source is disposed in the light slot and fixed at one of the fixing parts through the base; and the light source has different light-emitting directions upon being fixed at different ones of the plurality of fixing parts. In the light source assembly, the light slot is provided with the plurality of fixing parts and the light source may have different light-emitting directions upon being disposed at different ones of the fixing parts, such that a light source assembly in which the light-emitting direction is adjustable can be provided. Besides, the light source assembly has a simple structure, is convenient to operate, and may be applicable to transparent splicing devices with different sizes by simple combination.

In at least one embodiment of the present disclosure, the light source assembly including: a light source including a base and at least one luminous element disposed on the base; and a light slot including a plurality of fixing parts, wherein the light source is disposed in the light slot and fixed at one of the fixing parts through the base; and the light source has different light-emitting directions upon being fixed at different ones of the plurality of fixing parts.

For example, in an embodiment of the present disclosure, in the light source assembly, the fixing parts adopt equidistant arrangement.

For example, in an embodiment of the present disclosure, in the light source assembly, each of the fixing parts and the base of the light source are fixed through a clamping mode.

For example, in an embodiment of the present disclosure, in the light source assembly, each of the fixing parts includes at least one clamping structure matched with the base in thickness; the clamping structure includes a groove for accommodating and clamping the base; and grooves of different ones of the fixing parts have different deflection angles.

For example, in an embodiment of the present disclosure, in the light source assembly, the light slot includes a bottom plate and side walls disposed on two sides of the bottom plate; the side walls are opposite to each other; and the clamping structure is disposed on the side wall.

For example, in an embodiment of the present disclosure, in the light source assembly, the clamping structure includes two protrusions protruded out of a surface of the side wall; and the groove is formed between the two protrusions.

For example, in an embodiment of the present disclosure, in the light source assembly, the clamping structure includes a recess into the side wall; and the recess is the groove.

For example, in an embodiment of the present disclosure, the light source assembly further includes a platy fixing plate disposed in the light slot; the clamping structure includes an opening fixed on the fixing plate; and the opening forms the groove.

For example, in an embodiment of the present disclosure, in the light source assembly, each of the fixing parts includes paired clamping structures which are arranged oppositely on the side walls on two sides of the bottom plate.

For example, in an embodiment of the present disclosure, in the light source assembly, the side walls on two sides of the bottom plate are cambered structures arranged opposite to each other.

For example, in an embodiment of the present disclosure, in the light source assembly, an elastic element is also disposed in the groove.

For example, in an embodiment of the present disclosure, in the light source assembly, the luminous element includes a light-emitting diode (LED); and the base includes a printed circuit board (PCB).

For example, in an embodiment of the present disclosure, in the light source assembly, a reflecting film is also disposed on an inner side of the light slot.

For example, in an embodiment of the present disclosure, in the light source assembly, the reflecting film includes white reflecting materials coated on the light slot.

At least one embodiment of the present disclosure provides a backlight module, including any one of the above-mentioned light source assemblys.

For example, in an embodiment of the present disclosure, in the backlight module, the light source assembly is at least disposed at a corner position of the backlight module.

At least one embodiment of the present disclosure provides a display device, including any one of the above-mentioned backlight modules.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention, not limitative to the present disclosure.

Figure 6A:
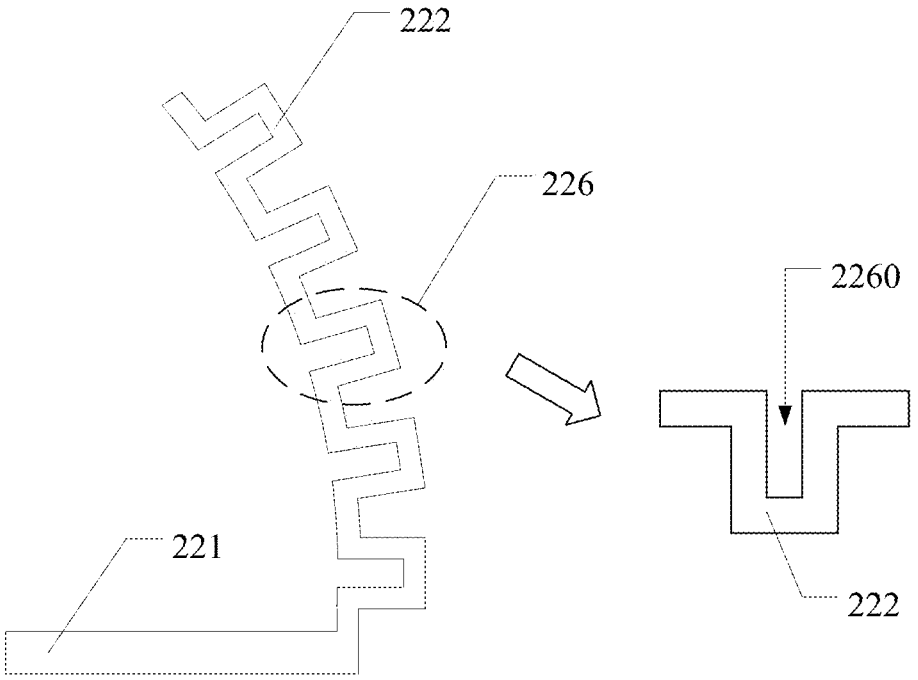
Figure 6B:
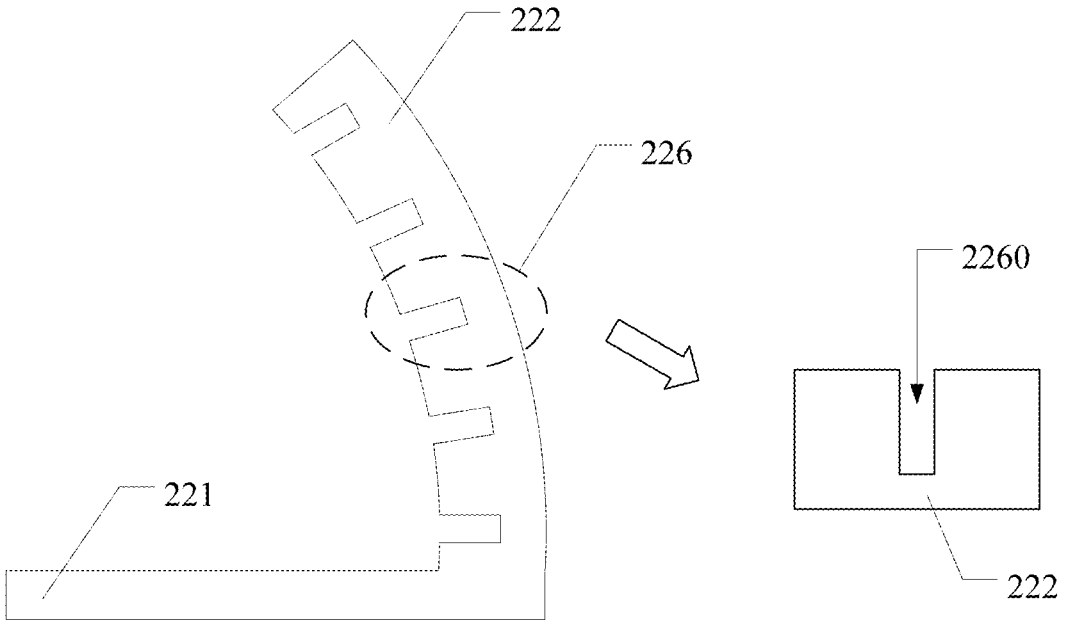
Figure 6C:
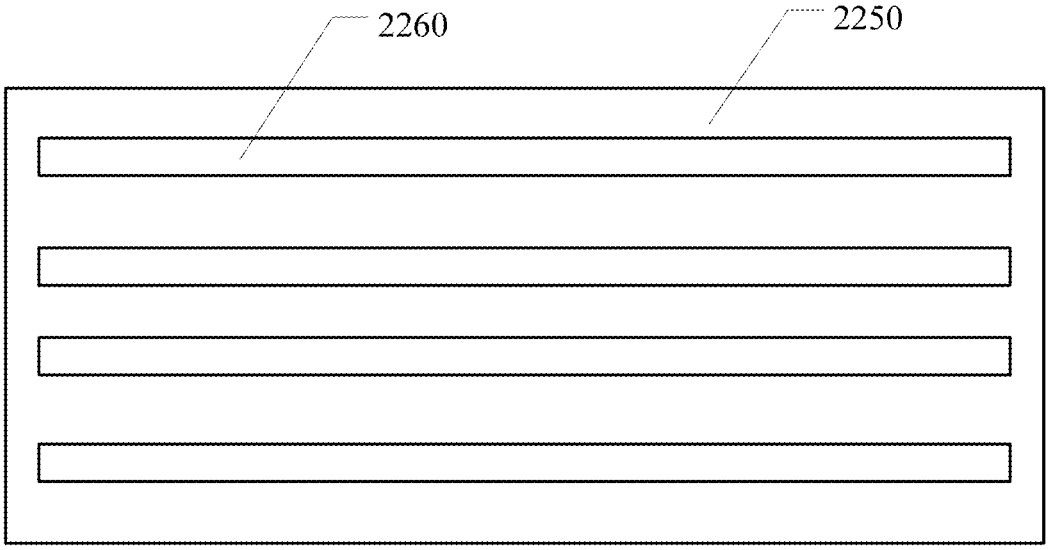
Figure 6D:
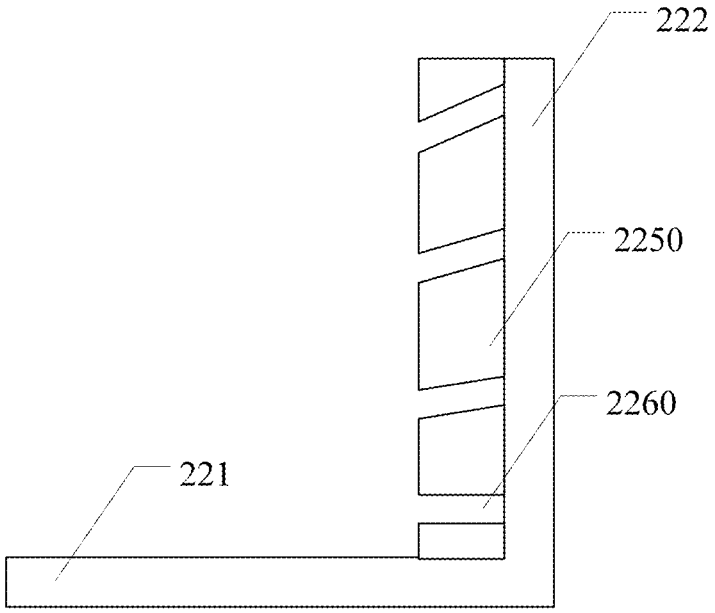
Figure 7A:
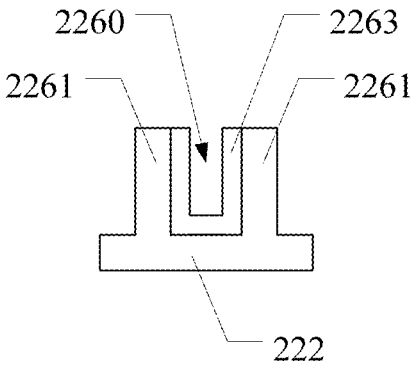
Figure 7B:
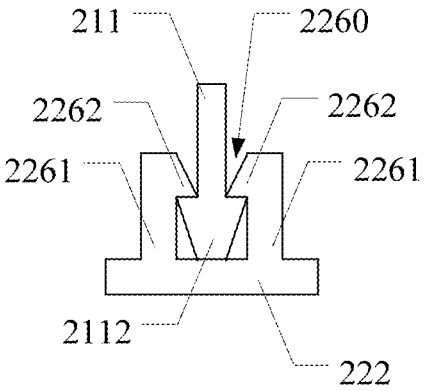
Figure 8:
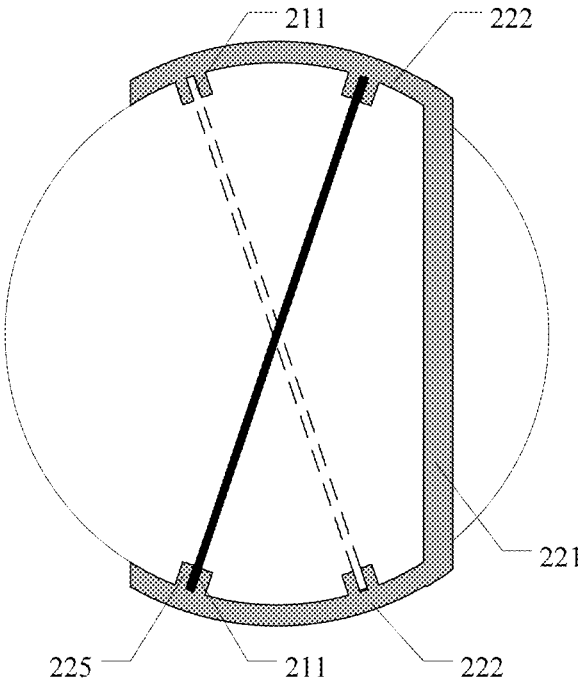
Figure 9:
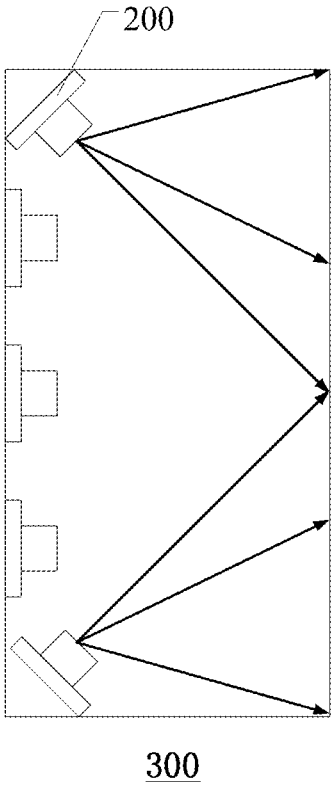
Figure 10:
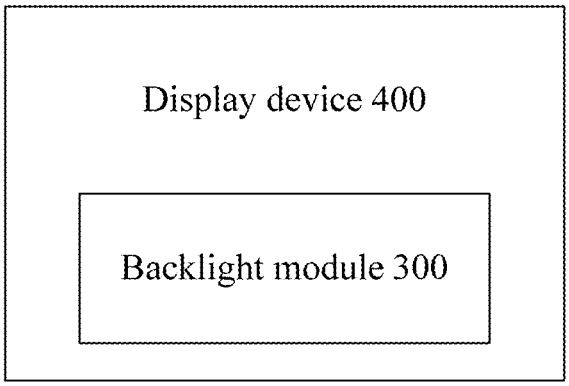

FIG. **6*a*** is a schematic structural view of a fixing part in an embodiment of the present disclosure;

FIG. **6*b*** is a schematic structural view of another fixing part in an embodiment of the present disclosure;

FIG. 6*c* is a schematic plan view of a fixing plate in an embodiment of the present disclosure;

FIG. 6*d* is a schematic structural view of a light source assembly adopting a fixing plate, provided by an embodiment of the present disclosure;

FIG. 7*a* is a schematic structural view of another fixing part in an embodiment of the present disclosure;

FIG. 7*b* is a schematic structural view of another fixing part in an embodiment of the present disclosure;

FIG. 8 is a schematic side view of a light source assembly provided by an embodiment of the present disclosure;

FIG. 9 is a schematic side view of a light source device provided by an embodiment of the present disclosure; and FIG. 10 is a view of a display device by an embodiment of the present disclosure.

DETAILED DESCRIPTION

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the disclosure. Based on the described embodiments herein, one person skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "includes," "including," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

Figure 1:
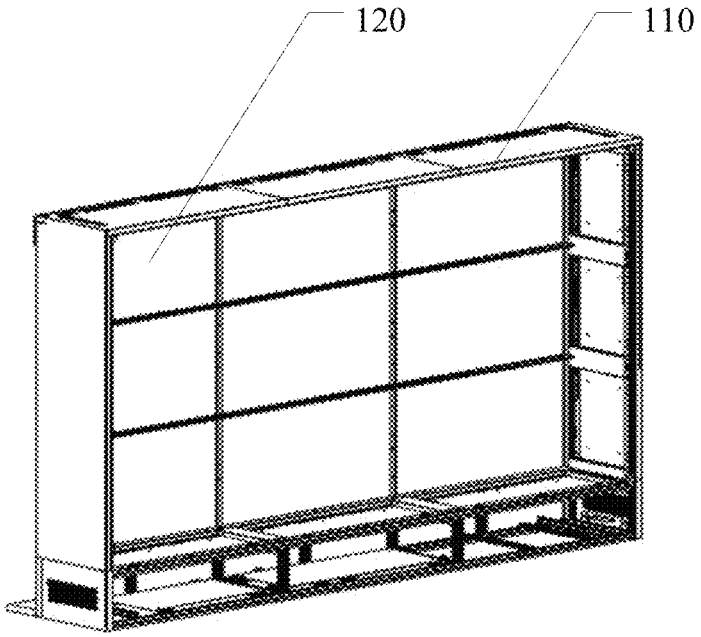
FIG. 1 is a schematic structural view of a transparent splicing device.

FIG. 1 is a schematic structural view of a transparent splicing device. As illustrated in FIG. 1, the transparent splicing device includes a plurality of transparent display areas 120 and a box 110 configured to fix the transparent display areas 120. The plurality of transparent display areas 120 are spliced to form a complete transparent display device; and an item to be displayed may be placed in the box 110. In general, most transparent splicing devices adopt spot lights or LEDs and a diffuser plate as a light source assembly, and the light source assembly is fixed on the box to provide light for the transparent splicing device. The inventor(s) of the application notices in the study that: the adoption of the spot lights as the light source assembly will result in the problems such as uneven brightness; and the spot lights is unfavorable for realizing the narrow-bezel design of the transparent splicing device due to a relatively large size.

Figure 2:
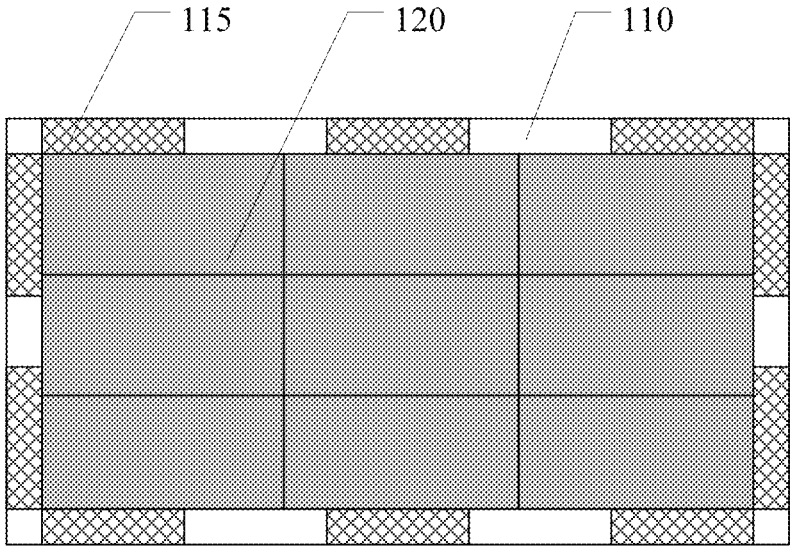
FIG. 2 is a schematic diagram of a transparent splicing device adopting an LED and a diffuser plate as a light source assembly.

FIG. 2 is a schematic front view of a transparent splicing device adopting LEDs and a diffuser plate as a light source assembly. As shown in FIG. 2, as a light source assembly 115 formed by the LEDs and the diffuser plate may result in the problems such as insufficient brightness, if higher brightness is required, the number of the light source assemblies 115 formed by the LEDs and the diffuser plate must be increased at the periphery of the transparent splicing device. However, the light source assemblies 115 formed by the LEDs and the diffuser plate, disposed at the periphery of the transparent splicing device, will interfere with viewing and hence affect the display effect of the transparent splicing device.

Figure 3:
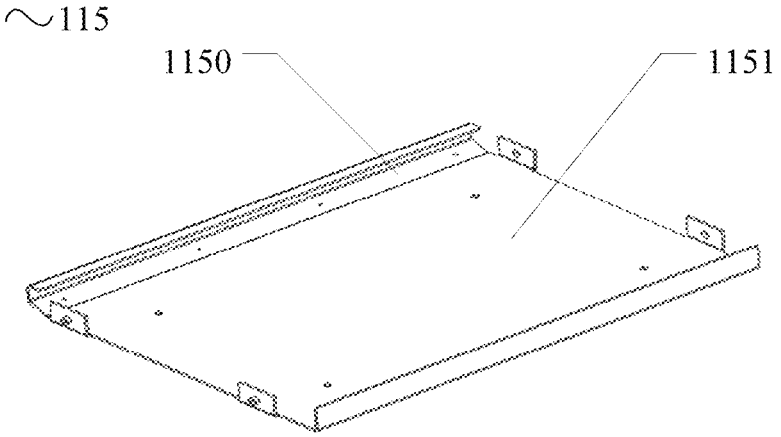
FIG. 3 is a schematic structural view of a backplane for a light source assembly.

FIG. 3 is a schematic structural view of a backplane of the light source assembly including the LEDs and the diffuser plate. As shown in FIG. 3, the backplane of the light source assembly includes a frame part 1150 for fixing LED light bars and a platy part 1151 for arranging the diffuser plate. As shown in FIG. 3, the platy part 1151 for arranging the diffuser plate has a large size, such that the application scope of the light source assembly will also be limited due to the large size, and meanwhile, is also unfavorable for transportation.

Embodiments of the present disclosure provide a light source assembly, a backlight module and a display device. The light source assembly includes a light source and a light slot. The light source may include a base and at least one luminous element disposed on the base. The light slot may include a plurality of fixing parts; the light source is disposed in the light slot and fixed at one of the plurality of fixing parts through the base; and the light source has different light-emitting directions upon being fixed at different ones of the fixing parts. In the light source assembly, the light slot is provided with the plurality of fixing parts and the light source may have different light-emitting directions upon being disposed at different ones of the fixing parts, so a light source assembly with adjustable light-emitting direction can be provided. Therefore, the light source assembly can improve the display effect of a transparent splicing device adopting the light source assembly provided by the embodiment by adjustment of the light-emitting direction, and can also avoid the phenomenon that light sources are disposed at the periphery of the transparent spicing device and interfere with viewing. In addition, the light source assembly has a simple structure, is convenient to operate, and can be applicable to transparent splicing devices with different sizes by simple combination, and hence can reduce the development cost of the transparent splicing device and shorten the development period.

Hereafter, the light source assembly, the backlight module and the display device will be described with reference to the accompanying drawings.

First Embodiment

Figure 4:
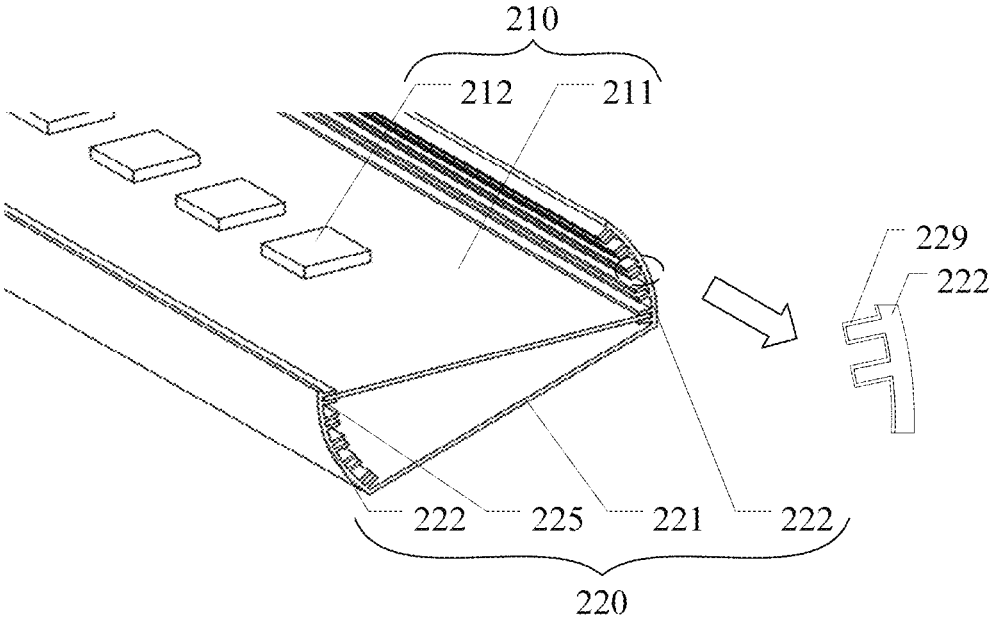
FIG. 4 is a schematic structural view of a light source assembly provided by an embodiment of the present disclosure.

The embodiment provides a light source assembly. As illustrated in FIG. 4, the light source assembly includes a light source 210 and a light slot 220. The light source 210 may include a base 211 and at least one luminous element 212 disposed on the base 211. The light slot 220 includes a plurality of fixing parts 225; the light source 210 is disposed in the light slot 220 and fixed at one of the plurality of fixing parts 225 through the base 211, that is, the base 211 may be fixed at one of the plurality of fixing parts 225, so as to fix the light source 210 in the light slot 220; and the light source 210 has different light-emitting directions upon being fixed at different ones of the fixing parts 225.

In the light source assembly provided by the embodiment, the light source 210 may be fixed in the fixing part 225 through the base 211. As different fixing parts 225 allow the base 211 to have different deflection angles, the direction of light emitted by the luminous element 212 disposed on the base 211 changes as well, so the light source 210 has different light-emitting directions. In this case, the light-emitting direction of the light source 210 may be adjusted by being disposed at different fixing parts 225. Therefore, the light source assembly provided by the embodiment can reasonably distribute light by adjustment of the light-emitting direction of the light source, improve the illumination effect, and hence improve the display effect of the transparent splicing device adopting the light source assembly provided by the embodiment. The light source assembly can also avoid the phenomenon that the light sources are disposed at the periphery of the transparent splicing device and interfere with viewing. In addition, the light source assembly has a simple structure, is convenient to operate, and can be applicable to transparent splicing devices with different sizes by simple combination, and hence can reduce the development cost of the transparent splicing device and shorten the development period.

For example, in the light source assembly provided by one example of the embodiment, as shown in FIG. 4, the fixing parts 225 may adopt equidistant arrangement along side walls of the light slot, so that the light-emitting direction of the light source 210 can be more conveniently adjusted. It should be noted that the accuracy in the adjustment of the light-emitting direction may also be improved by setting the number of the fixing parts. Upon the use environment requiring the light source assembly to have more options in the light-emitting direction, more fixing parts may be arranged. Upon the use environment requiring the light source assembly to have fewer options in the light-emitting direction, less fixing parts may be arranged. In addition, a measuring scale may also be arranged on the fixing part, so as to provide a specific value for the adjustment of the light-emitting direction. Of course, the embodiment of the present disclosure includes but is not limited thereto. The fixing parts may also be unequally spaced. For example, the fixing parts may be correspondingly arranged according to the case that more light-emitting directions are used in the actual use condition.

For example, in the light source assembly provided by one example of the embodiment, the fixing part and the base of the light source are fixed through a clamping mode. Of course, the embodiment includes but is not limited thereto. The fixing part may also be further fixed with the base of the light source through other fixing modes, e.g., threaded fixing, pin fixing or grip fixing. The embodiment of the present disclosure is not limited herein.

For example, in the light source assembly provided by one example of the embodiment, as shown in FIG. 4, the fixing part 225 may include at least one clamping structure matched with the base 211 in thickness, namely the clamping structure may be matched with the base in thickness to clamp and fix the base. Of course, the embodiment of the present disclosure includes but is not limited thereto. The fixing part may also be fixed with the base by other clamping means to allow the light source to have different light-emitting directions.

Figure 5:
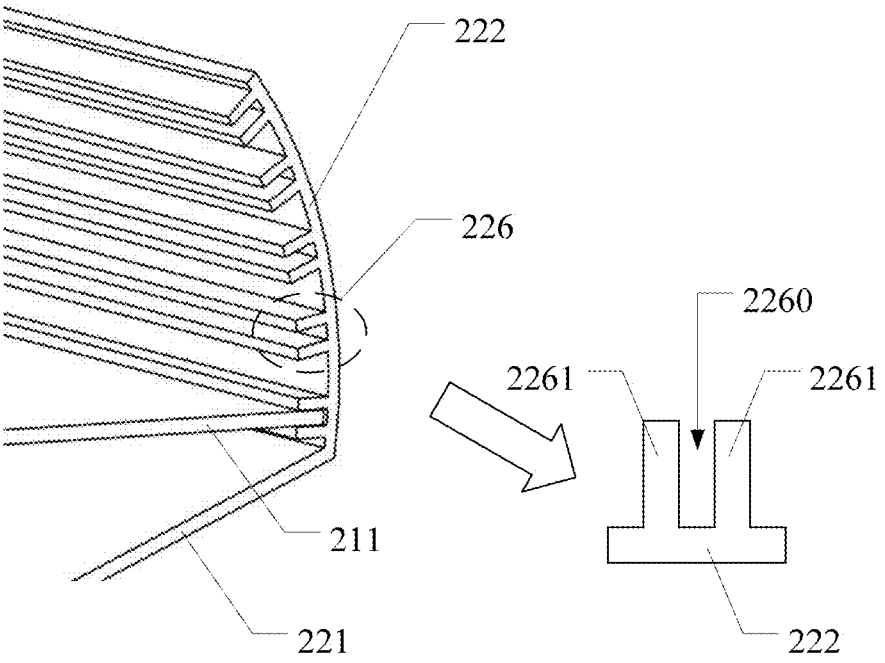
FIG. 5 is a schematic structural partial view of the light source assembly provided by an embodiment of the present disclosure.

For example, as shown in FIG. 4, the fixing part 225 may include paired clamping structures which are arranged oppositely on side walls 222 on two sides of a bottom plate 221. FIG. 5 is a schematic structural partial view of the light source assembly in FIG. 4. As shown in FIG. 5, the clamping structure 226 is matched with the base of the light source in thickness, so as to clamp and fix the base 211. The light source 210 is more firmly fixed in the light slot 220 through the paired clamping structures 226 which are arranged oppositely on the side walls 222 on two sides of the bottom plate 221, so that the stability of the light source assembly can be improved. It should be noted that: upon the paired clamping structures being disposed on the side walls, the distance between the bottom of grooves of the paired clamping structures may be just equal to the width of the base, so that the base can be more firmly fixed, and hence the stability of the light source assembly can be further improved.

For example, as shown in FIG. 5, the clamping structure 226 may be disposed on the side wall 222 and includes a groove 2260 configured to accommodate and clamp the base 211; and the grooves 2260 of different fixing parts 225 have different deflection angles. Thus, upon the base 211 being clamped and fixed in the grooves 2260 of different fixing parts 225, as the grooves 2260 have different deflection angles, the base 211 also has different deflection angels, so light emitted by the luminous element 212 on the base 211 can have different light-emitting directions.

For example, in the light source assembly provided by one example of the embodiment, as shown in FIG. 5, the clamping structure 226 includes two protrusions 2261 protruded out of a surface of the side wall 222; and the groove 2260 is formed between the two protrusions 2261. Moreover, by setting of the deflection angle of the two protrusions 2261, the groove 2260 may have specific deflection angle, so the light source fixed on the clamping structure 226 through the base 211 can have different light-emitting directions.

For example, in the light source assembly provided by another example of the embodiment, as shown in FIGS. 6*a* and 6*b*, the clamping structure 226 includes a recess 2260 into the side wall 222; and the recess 2260 is the groove 2260. As shown in FIG. 6*a*, the side wall 222 has small thickness, and the recess 2260 may be formed by bending the side wall outwards, For example, the recess as shown in FIG. 6*a* may be formed on the side wall by a stamping process. As shown in FIG. 6*b*, the side wall 222 has large thickness, and the recess 2260 may be formed by arranging a strip opening on the side wall 222, For example, the strip opening is formed by removing one part of materials of the side wall 222.

For example, the light source assembly provided by another example of the embodiment further includes a platy fixing plate disposed in the light slot. The fixing part may be an opening (through hole) on the fixing plate disposed in the light slot. The fixing plate may be fixed in the light slot (For example, fixed on the side wall or fixed on the bottom plate) by welding, riveting or other means. The base of the light source may be inserted into the opening. By setting of the deflection direction of the openings, the base has deflection direction, so the light source can have different light-emitting directions upon the light source being fixed in different openings. FIG. 6*c* is a top view of the fixing plate. As shown in FIG. 6*c*, the fixing plate 2250 is a rectangular plate, and a plurality of parallel openings 2260 are formed on the fixing plate 2250 disposed in the light slot. As shown in FIG. 6*d*, the plurality of openings 2260 have different deflection directions. The openings 2260 are the grooves 2260, so as to form a plurality of clamping structures; and the base of the light source may be respectively fixed in the clamping structures and hence has different light-emitting directions. As shown in FIG. 6*d*, the fixing plate 2250 is fixed on the side wall 222. Of course, the present disclosure includes but is not limited thereto. The fixing plate may also be obliquely arranged relative to the side wall or the bottom plate of the light slot.

For example, in the light source assembly provided by one example of the embodiment, as shown in FIG. 4, the light slot 220 includes a bottom plate 221 and side walls 222 disposed on two sides of the bottom plate 221. The side walls 222 disposed on two sides of the bottom plate 221 are arranged opposite to each other. It should be noted that: as the light slot includes the bottom plate and the side walls disposed on two sides of the bottom plate, the light emitted by the light source disposed in the light slot can have higher directivity. Upon a reflecting film being disposed in the light slot or the light slot has reflecting capacity, the setting can also improve the illumination intensity of the light source assembly in the required light-emitting direction.

Of course, the embodiment of the present disclosure includes but is not limited thereto. For example, the light slot may only include two side plates which are V-shaped, or the light slot may only include one cambered bottom plate.

For example, as shown in FIG. 4, the bottom plate 221 and the side walls 222 disposed on two sides of the bottom plate 221 are integrally formed, so as to reduce the number of parts in the light source assembly provided by the embodiment of the present disclosure, simplify the structure, and avoid various inconveniences caused by the loss of parts or the narrow mounting/use environment.

For example, in the light source assembly provided by one example of the embodiment, as shown in FIG. 4, the fixing part 225 may be disposed on the side wall 222. Of course, the embodiment of the present disclosure includes but is not limited thereto. The fixing part may also be disposed on the bottom plate.

For example, as shown in FIG. 4, the fixing parts 225 and the side walls 222 are integrally formed, so as to further reduce the number of parts in the light source assembly provided by the embodiment of the present disclosure, simplify the structure, and avoid various inconveniences caused by the loss of parts or the narrow mounting/use environments.

For example, in the light source assembly provided by one example of the embodiment, as shown in FIG. 4, the light source 210 may include a base 211 and a plurality of LEDs disposed on the base 211. It should be noted that the number of the LEDs on the base may be set according to the actually required brightness. Moreover, the brightness may be also improved or reduced by setting of the distribution density of the LEDs disposed on the base. The embodiment of the present disclosure is not limited herein.

For example, in the light source assembly provided by one example of the embodiment, as shown in FIG. 4, the base 211 may be a printed circuit board (PCB). Thus, the base 211 not only can be used for supporting a plurality of luminous elements 211 but also can provide a power source and a control circuit for the plurality of luminous elements 211. It should be noted that the plurality of luminescent elements can operate in time-sharing mode through the control circuit disposed on the base, so as to improve the service life of the plurality of luminous elements. In addition, the control circuit disposed on the base may also be adopted to control the emission sequence and the number of the plurality of luminous elements to provide various illumination effects, e.g., flashing or gradient effect. The embodiment of the present disclosure is not limited herein.

For example, in the light source assembly provided by one example of the embodiment, the plurality of luminescent elements 211 may emit light of different colors, and hence can provide colorful illumination effect.

For example, the base may be a flexible printed circuit board (FPCB), so as to provide convenience for the transportation and assembly of the light source assembly.

For example, the light source may be an LED light bar.

For example, in the light source assembly provided by one example of the embodiment, as shown in FIG. 4, a reflecting film 229 may also be disposed at an inner side of the light slot 220. Thus, light emitted by the light source 210 can be reflected by the reflecting film 229, so as to improve the light utilization rate.

For example, the reflecting film may be white reflecting materials or a metal coating coated on the light slot.

Or, for example, the light slot may be made from reflecting materials, so the light emitted by the light source can also be reflected without arranging the reflecting film, and hence the light utilization rate can be improved.

For example, in the light source assembly provided by one example of the embodiment, as shown in FIG. 7*a*, an elastic element 2263 may also be disposed on an inner side wall of the groove 2260, so that the base 211 can be more firmly clamped and fixed in the groove 2260. In addition, the elastic element 2263 may also protect the base 211 in the process of mounting the light source assembly, prevent damage caused by the collision or friction of the base 211 and the groove 2260, and hence improve the service life of the light source assembly.

For example, in the light source assembly provided by one example of the embodiment, the side walls and the clamping structures disposed on the side walls may be made from ductile materials, e.g., plastics. As this point, the thickness of the base may be set to be slightly greater than the width of the groove of the clamping structure, so that the base can be more firmly fixed on the side wall. Of course, the embodiment of the present disclosure includes but is not limited thereto.

For example, in the light source assembly provided by one example of the embodiment, as shown in FIG. 7*b*, inverted teeth 2262 may be formed at an inner side of the groove 2260 of the clamping structure, and the base 211 is correspondingly provided with inverted teeth 2112 matched with the inverted teeth 2262 at an inner side of the groove 2260, so that the base 21 can be more firmly fixed on the side wall 222. It should be noted that: upon the inner side of the groove of the clamping structure is provided with the inverted teeth and the base is correspondingly provided with the inverted teeth matched with the inverted teeth at an inner side of the groove, the base may slide into the groove from a side surface of the light slot; or upon the clamping structure being made from ductile materials, the base may be directly inserted into the groove. The embodiment of the present disclosure is not limited herein.

For example, in the light source assembly provided by one example of the embodiment, as shown in FIG. 8, the side walls 222 on two sides of the bottom plate 221 are cambered structures arranged opposite to each other.

For example, in the light source assembly provided by one example of the embodiment, as shown in FIG. 8, the cambered structure may be a circular arc adopting the width of the base 211 as the diameter. As shown in FIG. 8, the base 211 may be deflected in the cambered structure by being fixed on different fixing parts 225, and in the case of deflecting different angles, the distance between corresponding fixing parts 225, namely the width of the base 211, is always kept consistent, so that the fixing part 225 can firmly fix the base 211 on the side wall 222 upon the base deflecting in the cambered structure and having different deflection angels. Thus, except that the light-emitting direction is different, upon the base 211 being fixed at different fixing parts 225, the luminous brightness of the light source is more stable. It should be noted that the width of the base refers to the distance between two sides of the base, making contact with two side walls, upon the base being clamped in the cambered structure.

Second Embodiment

The embodiment provides a backlight module. As illustrated in FIG. 9, the backlight module includes any light source assembly provided by the first embodiment. As the backlight module includes any light source assembly provided by the first embodiment, the backlight module has the effects corresponding to the effects of the light source assembly. The repeated portions will be omitted herein.

For example, in the backlight module provided by one example of the embodiment, as shown in FIG. 9, the light source assembly 200 is at least disposed at a corner position of the backlight module 300. Thus, the light source assembly 200 disposed at the corner position of the backlight module can reasonably distribute light by adjustment of the light-emitting direction of the light source, improve the illumination effect, and hence improve the display effect of the transparent splicing device adopting the light source assembly provided by the embodiment. Moreover, the light source component can also avoid the phenomenon that the light sources are disposed at the periphery of the transparent splicing device and interfere with viewing.

For example, in the backlight module provided by one example of the embodiment, the backlight module may be applied in a transparent splicing device, e.g., an advertising show cupboard or a physical goods display box.

Third Embodiment

The embodiment of FIG. 10 provides a display device 400, which may include the backlight module 300 provided by any example of the second embodiment. As the backlight module provided by any example of the second embodiment is adopted, the display device provided by the embodiment is convenient in assembly and can reduce the cost and shorten the development period. For example, the display device includes an advertising show cupboard, a physical goods display box, etc.

The following points must be noted:

(1) Only structures relevant to the embodiments of the present disclosure are involved in the accompanying drawings of the embodiments of the present disclosure, and other structures may refer to the prior art.

(2) For clarity, the thickness and the size of layers or microstructures are enlarged in the accompanying drawings of the embodiments of the present disclosure.

(3) The characteristics in the same embodiment and different embodiments of the present disclosure may be mutually combined without conflict.

The foregoing is only the preferred embodiments of the present disclosure and not intended to limit the scope of protection of the present disclosure. Any change or replacement that may be easily thought of by those skilled in the art within the technical scope disclosed by the present disclosure shall fall within the scope of protection of the present disclosure. Therefore, the scope of protection of the present disclosure shall be defined by the appended claims.

The application claims priority to the Chinese patent application No. 201620673074.6, filed Jun. 29, 2016, the disclosure of which is incorporated herein by reference as part of the application.

The invention claimed is:

1. A light source assembly, comprising:

a light source comprising a base and at least one luminous element disposed on a surface of the base; and a light slot comprising a plurality of fixing parts, wherein the light source is disposed in the light slot and fixed at one of the fixing parts through the base; and the light source has different light-emitting directions upon being fixed at different ones of the plurality of fixing parts, a reflecting film is also disposed on an inner side of the light slot, each of the fixing parts comprises at least one clamping structure matched with the base in thickness; the clamping structure comprises a groove for accommodating and clamping the base; and grooves of different ones of the fixing parts have different deflection angles, the light slot comprises a bottom plate and side walls disposed on two sides of the bottom plate; the side walls are opposite to each other; and the clamping structure is disposed on the side wall, the side walls on two sides of the bottom plate are cambered structures arranged opposite to each other, and an elastic element is also disposed in the groove, the light slot is a single piece component, the elastic element and the base are two independent components, the light slot further comprises an opening, located between the side walls disposed on two sides of the bottom plate, an orthographic projection of the opening on the base covers the at least one luminous element, and orthographic projections of the side walls disposed on two sides of the bottom plate are not overlapped with the at least one luminous element.

2. The light source assembly according to claim 1, wherein the fixing parts adopt an equidistant arrangement.

3. The light source assembly according to claim 1, wherein each of the fixing parts and the base of the light source are fixed through a clamping mode.

4. The light source assembly according to claim 1, wherein the clamping structure comprises two protrusions protruded out of a surface of the side wall; and the groove is formed between the two protrusions.

5. The light source assembly according to claim 1, wherein the clamping structure comprises a recess into the side wall; and the recess is the groove.

6. The light source assembly according to claim 1, further comprising a platy fixing plate disposed in the light slot; the clamping structure comprises an opening fixed on the fixing plate; and the opening forms the groove.

7. The light source assembly according to claim 1, wherein each of the fixing parts comprises paired clamping structures which are arranged oppositely on the side walls on two sides of the bottom plate.

8. The light source assembly according to claim 1, wherein the luminous element comprises a light-emitting diode (LED); and the base comprises a printed circuit board (PCB).

9. The light source assembly according to claim 1, wherein the reflecting film comprises white reflecting materials coated on the light slot.

10. A backlight module, comprising the light source assembly according to claim 1.

11. The backlight module according to claim 10, wherein the light source assembly is at least disposed at a corner position of the backlight module.

12. A display device, comprising the backlight module according to claim 10.

13. The backlight module according to claim 1, wherein the reflecting film is disposed on an entire surface of inner sides of the side walls disposed on two sides of the bottom plate.

* * * * *